US008256251B2

(12) United States Patent
Kondratuk

(10) Patent No.: US 8,256,251 B2
(45) Date of Patent: Sep. 4, 2012

(54) MORTISE DEADBOLT LOCK CAM ENGAGEMENT DEVICE

(75) Inventor: Michael W. Kondratuk, Brookings, SD (US)

(73) Assignee: Larson Manufacturing Company, Brookings, SD (US)

( * ) Notice: Subject to any disclaimer, the term of this patent is extended or adjusted under 35 U.S.C. 154(b) by 0 days.

(21) Appl. No.: 12/433,486

(22) Filed: Apr. 30, 2009

(65) Prior Publication Data

US 2009/0211317 A1 Aug. 27, 2009

Related U.S. Application Data

(63) Continuation of application No. 11/875,523, filed on Oct. 19, 2007, now abandoned.

(51) Int. Cl.
*E05B 63/14* (2006.01)
*E05B 65/06* (2006.01)

(52) U.S. Cl. ..... 70/107; 70/134; 70/380; 70/DIG. 62; 292/137; 292/140; 292/142; 292/143; 292/169; 292/DIG. 41; 292/DIG. 52

(58) Field of Classification Search ..... 70/107, 70/134, 352, DIG. 62, 380; 292/142, 169, 292/137, 143, DIG. 64, 140, DIG. 51, DIG. 52, 292/DIG. 41, 37, 39, 159, 160, 169.15, 172, 292/187
See application file for complete search history.

(56) References Cited

U.S. PATENT DOCUMENTS

| | | | |
|---|---|---|---|
| RE8,158 | E | 4/1878 | Yale et al. |
| 953,928 | A | 7/1910 | Solywoda |
| 967,377 | A | 8/1910 | Henry |
| 1,383,128 | A | 6/1921 | Larsen |
| 1,627,420 | A | 5/1927 | Thomas |
| 1,752,559 | A | 4/1930 | Hurd |
| 1,979,805 | A | 11/1934 | Main |
| 4,683,733 | A | 8/1987 | Marin |
| 6,871,884 | B2 | 3/2005 | Hoffmann et al. |
| 6,983,962 | B2 | 1/2006 | Keightley |
| 7,197,903 | B2 | 4/2007 | Char et al. |
| 7,213,426 | B2 | 5/2007 | Qing |
| 2003/0106350 | A1 | 6/2003 | Char et al. |
| 2004/0017087 | A1 | 1/2004 | Ayres et al. |
| 2006/0290141 | A1 | 12/2006 | ValHellemont |

*Primary Examiner* — Lloyd Gall
(74) *Attorney, Agent, or Firm* — Nawrocki, Rooney & Sivertson, P.A.

(57) ABSTRACT

A stop arrangement for precluding disengagement of a mortise deadbolt lock element by a cam which is employed to extend and retract the element. The arrangement employs first and second stop arms angularly spaced from a cam, which are rotatable, along with the cam, and which engage the lock element to preclude over-rotation.

10 Claims, 4 Drawing Sheets

MORTISE DEADBOLT LOCK CAM ENGAGEMENT DEVICE

This is a continuation of application Ser. No. 11/875,523 filed on Oct. 19, 2007, now abandoned.

TECHNICAL FIELD

The present invention deals broadly with entryway doors. More narrowly, however, it deals with mortise deadbolt locks for such doors. The specific focus of the invention is apparatus for precluding a cam which urges a deadbolt lock element from entering a "lock-out" situation.

BACKGROUND OF THE INVENTION

Mortise deadbolt locks are utilized in doors installed in both residential and commercial facilities. A mortise deadbolt lock element is installed within a door section and is extended or retracted by means of an escutcheon assembly typically inside the facility in which the door is installed. It will be understood that, under appropriate circumstances where an individual is seeking to obtain entrance from the outside, operation of an outside escutcheon assembly will also facilitate the mortise deadbolt lock element's retraction.

Technical operation of the deadbolt lock element occurs by means of a cam which is rotated by either the inside or outside escutcheon assembly. Many prior art mortise locks have encountered a situation wherein the cam which urges the lock element to extended and retracted positions slips by the lock element. The cam, thereafter, is prevented from reentering the actuation area, and the door cannot be unlocked. This situation is referred to as a "lock-out" because, when it occurs, the deadbolt element cannot be retracted. It is desirable, therefore, to maintain the cam within the deadbolt actuation area. If the cam is so maintained, it may always be employed to retract the deadbolt element.

Recent attempts have been made to rectify this problem. Cam mortise locks have been devised that employ a cam stop which protrudes from one or the other sides of the lock body. Such stops are attached to the inside surface of the lock body. Such stops are located to allow for actuation of the deadbolt lock when desired.

This design of a mortise deadbolt lock has a number of inherent problems, however. Illustrative is a requirement for accurate tolerances between the side plate cam stops, the cam and the deadbolt lock element. If the tolerances necessary are not precisely met, the lock will not function properly.

Aside from the issue of tolerances, there is at least one other disadvantage with respect to the side plates in accordance with the prior art. As one will see, in view of the prior art, stampings can be very difficult to accomplish. This is so since there are stops to be attached to the inner walls of the side plates.

Further, in view of the manner in which the prior art cam stops are mounted, the stops can have a degree of weakness. In the extreme, a stop can even become dislodged from its intended location.

Further, the manufacture and assembly of such an embodiment has a degree of complexity. It employs more parts than necessary, and those parts, as previously discussed, can lead to inherent weaknesses.

It is to these dictates and problems of the prior art that the present invention is directed. It is an improved mortise deadbolt lock which addresses the problems of the prior art.

SUMMARY OF THE INVENTION

The present invention is a mechanism for facilitating maintenance of a cam, which serves to move a deadbolt lock element between a retracted, unlocked position and an extended, locked position, within an area of operative engagement with the lock element. The apparatus includes structure for mounting the cam for rotation about an axis. The cam is mounted for rotation between a first circumferential position in which it urges a head or forward portion of the deadbolt lock element such that the lock element is in the extended position, and a second circumferential position in which it urges a tail or rear portion of the lock element such that the element is in the retracted position. The first and second positions of the cam are spaced angularly relative to one another. The invention further includes a first stop arm which extends radially from the axis and is spaced angularly from the cam at a defined angle. The angle at which it is spaced from the cam is such that, when the cam is in its first circumferential position, the first stop arm engages the tail of the deadbolt lock element. A second stop arm is also included. The second stop arm also extends radially from the axis and is spaced angularly from the cam at a defined angle. The angle is such that, when the cam is in its second circumferential position, the second stop arm engages the head of the lock element. The stops thereby preclude rotation of the cam out of its arc of operation.

In a preferred embodiment, the cam and the first and second stop arms comprise a unitary assembly. In such an embodiment, the first stop arm is spaced from the cam generally at the same angle, but in an opposite direction, as the second stop arm is spaced from the cam.

In one embodiment, distal ends of the stop arms are beveled so that, when each engages the lock element, the distal end engaging the element is flush with a surface of the lock element which it engages. In such an embodiment also, the stop arms, spaced in opposite directions and generally at equal angles, are substantially symmetrical with respect to the cam.

The present invention is thus an improved apparatus for facilitating operative engagement of the actuation cam with the deadbolt lock element and wherein a "lockout" situation is precluded. More specific features and advantages obtained in view of those features will become apparent with reference to the DETAILED DESCRIPTION OF THE INVENTION, appended claims and accompanying drawing figures.

DETAILED DESCRIPTION OF THE INVENTION

Figure 1:
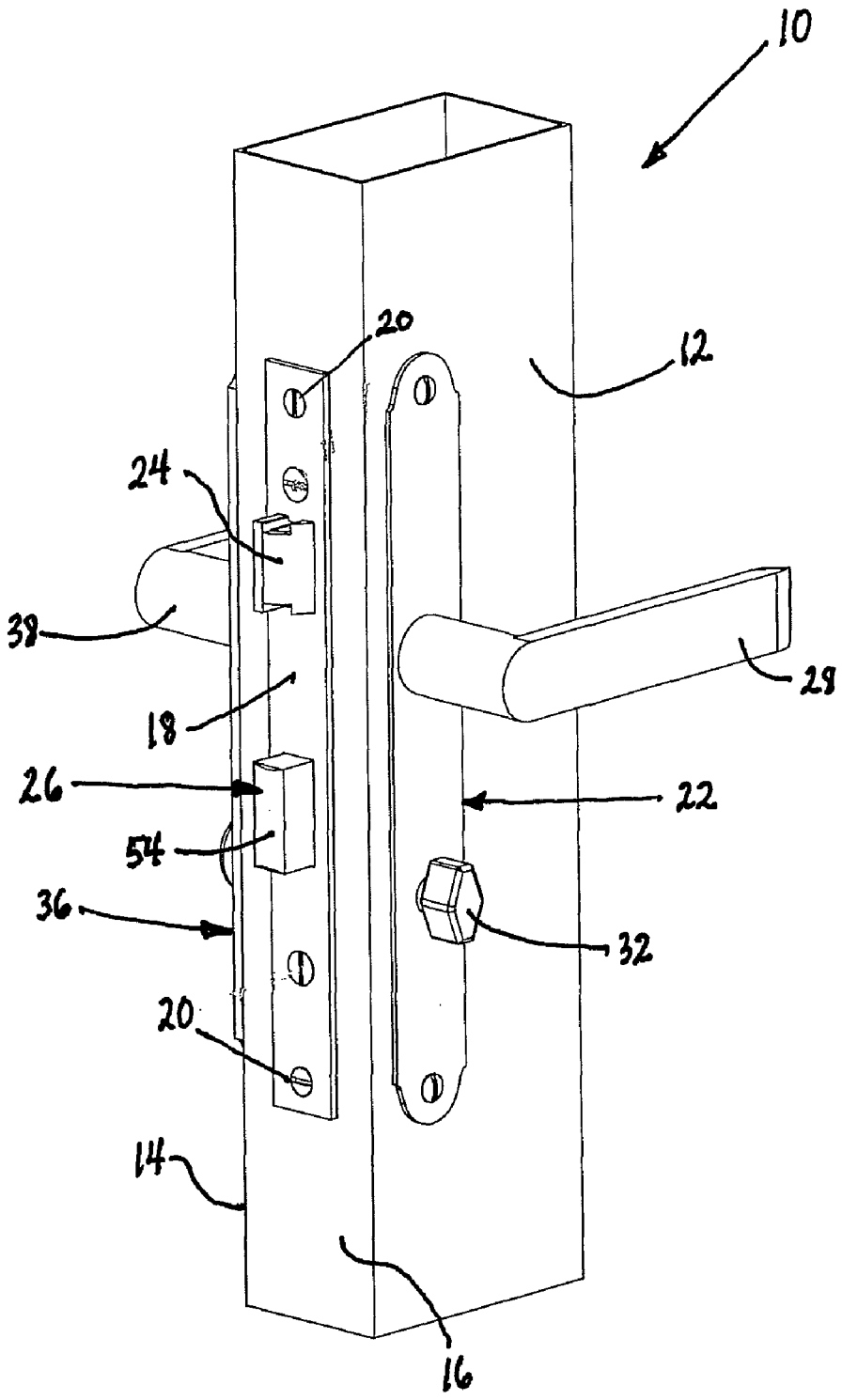
FIG. 1 is an isometric view of the environment within which the present invention functions.

Referring now to the drawing figures wherein like reference numerals denote like elements throughout the several views, FIG. 1 illustrates a door extrusion 10 in which the present invention functions. It is in the environment illustrated in which the present invention serves to accomplish its intended purpose. The extrusion 10 includes a surface 12 which faces inwardly into the building in which the door extrusion 10 is mounted, and an outwardly facing surface 14. Generally normal to those two surfaces 12, 14 and interconnecting them is a surface 16 within which locking components are received to extend therethrough. A plate 18 is affixed to the surface 16 by means of screws 20. The plate 18, in turn, provides for ingress and egress of a closure latch 24 and a deadbolt lock element 26.

An escutcheon assembly 22 through which a spindle (not shown in FIG. 1), operated by a lever handle 28, passes, is mounted to an inwardly facing surface. The inner escutcheon assembly 22 also mounts a turn knob 32, rotation of which causes a deadbolt spindle (not shown) to rotate to move the deadbolt lock element 26 between retracted and extended positions. FIG. 1 illustrates the mechanism with the deadbolt locking element 26 in its extended position.

It will be understood that an outer escutcheon assembly 36 similarly mounts a lever handle 38 and a key face plate. The outer lever handle 38 also serves to rotate the spindle for retracting the latch 24, and a key face plate (not shown) enables the spindle of the deadbolt element 26 to be rotated with key means.

The prior art includes mortise lock structures for precluding movement of a cam beyond intended angular boundaries. Such a cam urges the deadbolt lock element to an extended position. Cam movement is limited by a cam stop affixed to a side plate. Affixation to the side plate is accomplished in any appropriate manner. It is intended that the cam stop prevent the cam from rotating in one direction beyond the deadbolt actuation range.

A second cam stop affixed to a side plate also would be engaged by the cam when it has been rotated in an opposite direction to engage the tail of the deadbolt lock element in order to effect retraction. When full retraction occurs, the cam will engage the second cam stop to preclude over-rotation. It will be understood that such a prior art structure thus described is subject to the shortcomings and problems previously discussed.

Figure 2:
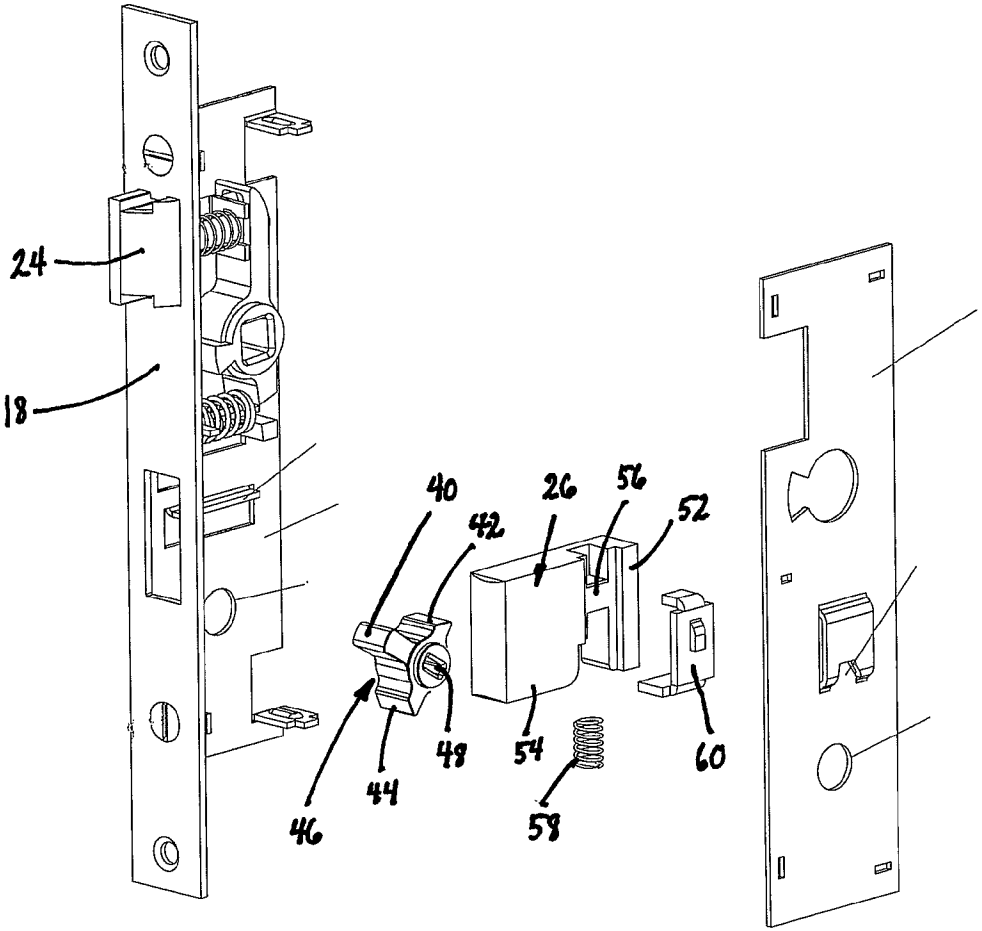
FIG. 2 is an exploded view of the mortise lock structure in accordance with the present invention.
Figure 4:
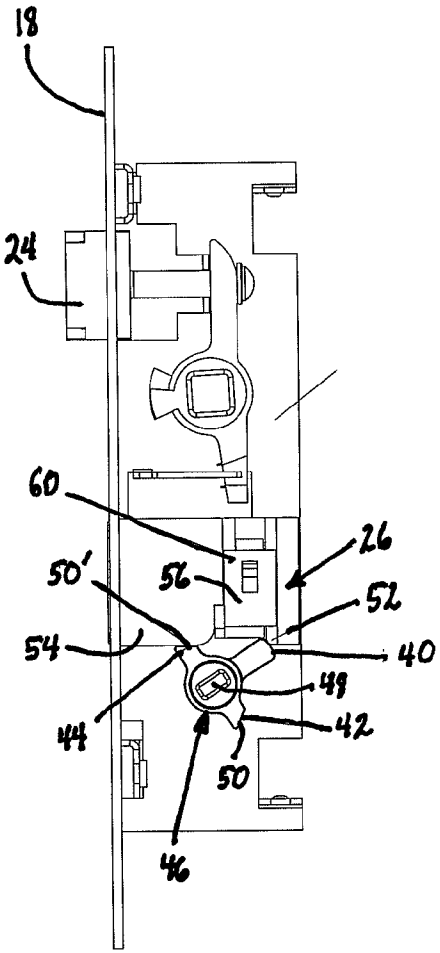
FIG. 4 is a view similar to FIG. 3 with the lock element in the retracted position.
Figure 3:
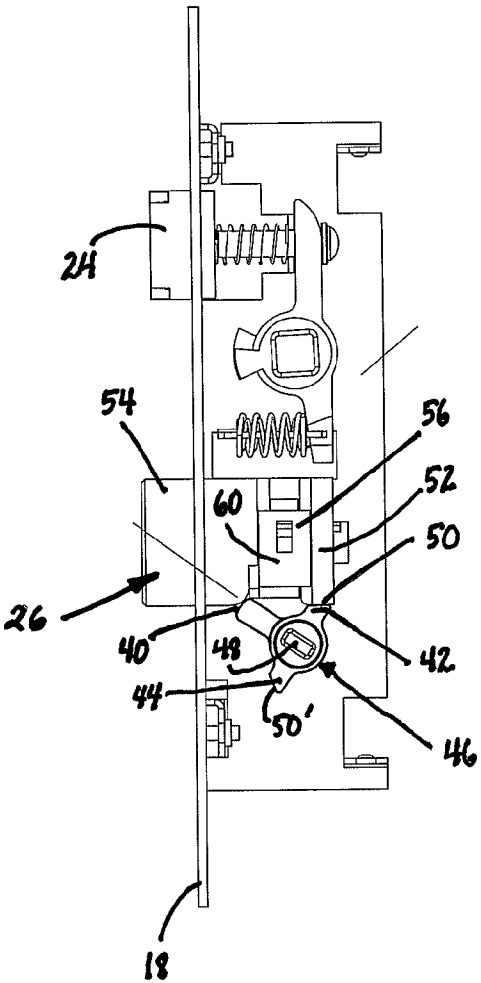
FIG. 3 is a side view of a mortise lock in accordance with the present invention and with the lock element in an extended position.

FIGS. 2-4 illustrate a structure in accordance with the present invention. While the actual structure may vary, a basic generic structure is illustrated with the exception of the deadbolt cam restricting architecture. Typically, included would be escutcheon assemblies, lever handles, a turn knob, a deadbolt lock element, etc.

Figure 5:
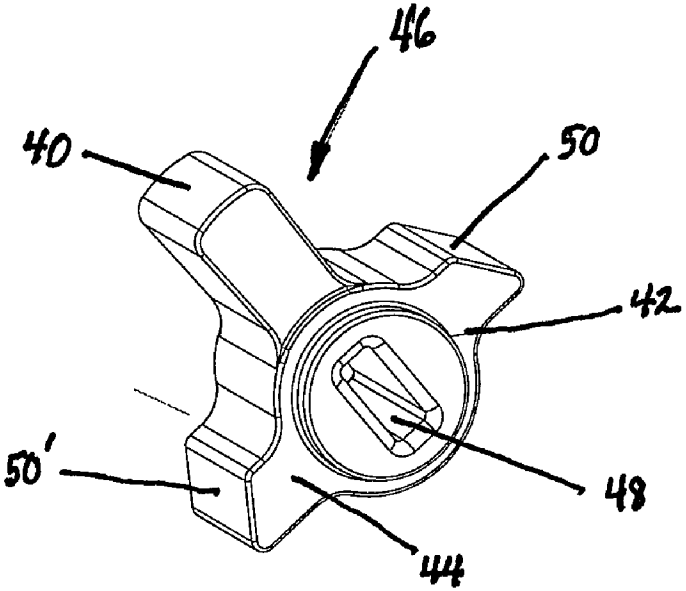
FIG. 5 is an isometric view of the cam element with stop arms attached thereto.

The essence of the present invention is a cam 40 which, in a new and unique manner, cooperates with a pair of stop arms 42, 44 to preclude over-rotation of the cam 40 in opposite directions. FIG. 5 illustrates the cam assembly 46. The assembly 46 includes the cam 40 which, it is considered optimum for manufacturing purposes, is aligned with the elongation of a spindle receiver 48. A pair of stop arms 42, 44 are carried by the assembly 46, the stop arms being spaced angularly from the cam 40 and integrally formed therewith. One stop arm is spaced from the cam on either side thereof. It is anticipated that angular spacing would be within a range of 75°-90°, although such a range is not exclusive. The specific angular spacing, however, is a function of dimensions of the deadlock element 26, the length of the cam 40, etc.

FIG. 5 illustrates a cam assembly 46 wherein the stop arms 42, 44 are substantially symmetrical with regard to the cam 40 and spindle receiver 48. Such a construction facilitates the manufacture and operation of the present invention.

As illustrated in the drawings, and in FIG. 5 in particular, distal ends of the stop arms can be beveled as at 50, 50'. The beveling is for a purpose as will be discussed hereinafter with regard to operation of the apparatus. It will be understood that beveling will not destroy symmetry of the cam assembly 46.

Figure 6:
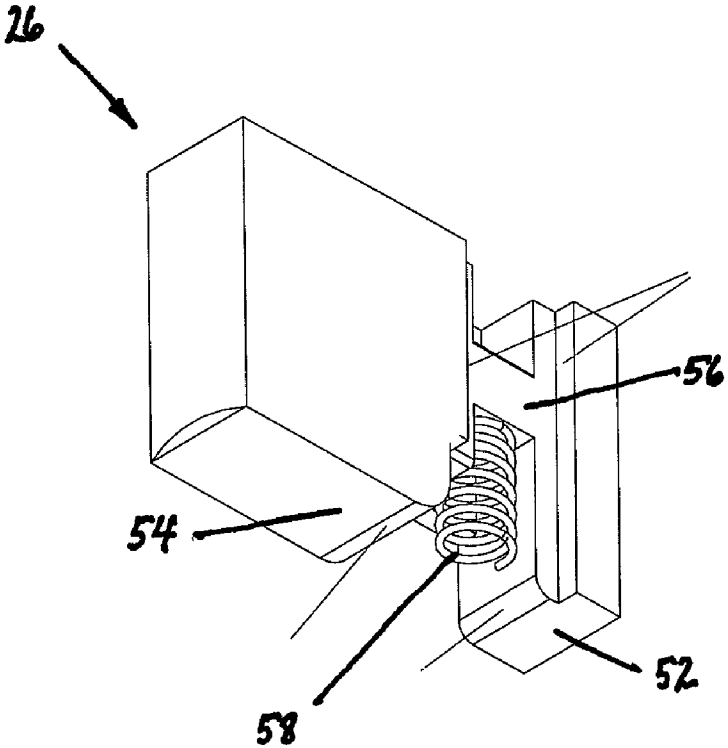
FIG. 6 is an isometric view of the deadbolt element.

FIG. 6 illustrates a deadbolt lock element 26 as is typically used in the prior art. It is such a lock element that the present invention is intended to move between retracted and extended positions. The lock element 26 includes a smaller tail portion 52 which remains within the door extrusion at all times. A head portion 54, larger in dimensions than the tail portion 52, is disposed for reciprocation in extension from and retraction within the door extrusion 10. Such extension and retraction positions are illustrated in FIGS. 3 and 4. An intermediate interconnecting portion 56 serves to receive and operate, along with a deadbolt spring 58, a position stop 60 which allows a person to securely hold the deadbolt lock element 26 in the retracted and extended positions.

Referring now to FIGS. 3 and 4, the cam assembly 46 is illustrated as mounted in a position so that the cam 40 can urge the deadbolt lock element 26 either outwardly to its extended position, as shown in FIG. 3, or inwardly to its retracted position, as it rotates with respect to an axis of rotation, as illustrated in FIG. 4. The deadbolt spindle (not shown) is rotated from the inside by the turn knob 32. The person manipulating the door lock can, thereby, selectively choose whether the deadbolt lock element 26 is to be in its retracted or extended position. Rotation of the turn knob 32 in a counterclockwise direction, as viewed in FIGS. 3 and 4, will effect engagement of the head 54 of the locking element 26 and urge the locking element to its extended position. Such extension will continue as long as the spindle is rotating the cam assembly 46 in a counterclockwise direction, as viewed in FIGS. 3 and 4, and until the distal end of the first stop arm 42 engages the tail 52 of the locking element 26. As previously discussed, the distal end of the first stop arm 42 is beveled. The beveling is at an angle such that, when engagement with the tail 52 of the locking element 26 occurs, the distal end of the first stop arm will be in full engagement with the surface of the tail of the locking element 26 which it engages and will apply a force against the locking element 26 substantially perpendicular to the axis along which element 26 reciprocates.

A clockwise rotation of the turn knob will, in turn, effect a concurrent rotation of the spindle and the cam assembly 46. As such rotation occurs, the cam 40 will, having engaged the tail 52 of the locking element, urge the locking element in a retraction direction. Such movement will occur until the second stop arm 44 engages the head 54 of the locking element 26. As in the case of the first stop arm, the bevel at the distal end of the second stop arm is inclined so that the distal end is in full engagement with the surface of the head 54 of the locking element 26 it engages when engagement occurs. Again, such engagement effects a very positive stop.

As will be able to be seen, the stop arms 42, 44 positively preclude the cam assembly 46 from being able to be rotated beyond the limits defined for it. Consequently, a "lockout" situation is concurrently precluded.

In view of the structure of the present invention and the improved operation able to be achieved in view of that structure, the present invention is an assembly which allows for locking and unlocking of a deadbolt element which is far better than any structure and method known in the prior art. It will be understood that this disclosure, in many respects, is only illustrative. Changes may be made in details, particularly in matters of shape, size, material, and arrangement of parts without exceeding the scope of the invention. Accordingly, the scope of the invention is as defined in the language of the appended claims.

What is claimed is:

1. In combination with a door lock employing a mortise deadbolt lock element, apparatus to facilitate operative engagement of a deadbolt actuation cam with the mortise deadbolt lock element, wherein the lock element is disposed for movement only in opposite directions along a reciprocal axis between a retracted position and an extended position, comprising:

means mounting the cam for rotation about a rotational axis in a first direction wherein the cam urges a head of the mortise deadbolt lock element to the extended position, and a second, opposite direction wherein the cam urges a tail of the mortise deadbolt lock element to the retracted position; and a stop arm extending radially from said rotational axis and spaced at a fixed angle from the cam such that, as the cam approaches a rotated position, said stop arm engages said mortise deadbolt element and applies a force in a direction substantially perpendicular to said reciprocal axis, to said tail of the mortise deadbolt lock element to preclude further rotation of the cam in a direction in which it moves to urge the mortise deadbolt lock element into the extended position.

2. In combination with a door lock employing a mortise deadbolt lock element, apparatus to facilitate operative engagement of a deadbolt actuation cam with the mortise deadbolt lock element, wherein the lock element is disposed for movement only in opposite, substantially horizontal directions between a retracted position and an extended position, comprising:

means mounting the cam for rotation about a rotational axis in a first direction wherein the cam urges a head of the mortise deadbolt lock element to the extended position, and a second, opposite direction wherein the cam urges a tail of the mortise deadbolt lock element to the retracted position; and a stop arm extending radially from said rotational axis and spaced at a fixed angle from the cam such that, as the cam approaches a first rotated position, said stop arm engages said mortise deadbolt element and applies a force in a substantially vertical direction to engage said tail of the mortise deadbolt lock element to preclude further rotation of the cam in a direction in which it moves to urge the mortise deadbolt lock element into the extended position.

3. In combination with a door lock employing a mortise deadbolt lock element, apparatus for insuring operative engagement of a deadbolt actuation cam with the mortise deadbolt lock element, wherein the lock element is disposed for movement only in opposite, generally horizontal directions along a reciprocal axis between a retracted position and an extended position, comprising:

means mounting the cam for rotation about a rotational axis in a first direction wherein the cam urges a head of the mortise deadbolt lock element to the extended position, and a second, opposite direction wherein the cam urges a tail of the mortise deadbolt lock element to the retracted position;

a first stop arm extending radially from said rotational axis and spaced at a fixed angle from the cam such that, as the cam approaches a first rotational position, said first stop arm engages said mortise deadbolt lock element and applies a force in a substantially vertical direction to engage said tail of the mortise deadbolt lock element to preclude further rotation of the cam in said first direction; and a second stop arm extending radially from said rotational axis and spaced at a fixed angle from the cam such that, as the cam approaches a second rotational position, said second stop arm engages said mortise deadbolt lock element and applies a force in a substantially vertical direction to said head of the mortise deadbolt lock element to preclude further rotation of the cam in said second direction.

4. In combination with a door lock employing a mortise deadbolt lock element, apparatus for insuring operative engagement of a deadbolt actuation cam with the mortise deadbolt lock element, wherein the lock element is disposed for movement only in opposite directions along a reciprocal axis between a retracted position and an extended position, comprising:

means mounting the cam for rotation about a rotational axis in a first direction wherein the cam urges a head of the mortise deadbolt lock element to the extended position, and a second, opposite direction wherein the cam urges a tail of the mortise deadbolt lock element to the retracted position;

a first stop arm extending radially from said rotational axis and spaced at a fixed angle from the cam such that, as the cam approaches a first rotational position, said first stop arm engages said mortise deadbolt lock element and applies a force in a direction along a third axis substantially perpendicular to the reciprocal axis to preclude further rotation of the cam in said first direction; and a second stop arm extending radially from said rotational axis and spaced at a fixed angle from the cam such that, as the cam approaches a second rotational position, said second stop arm engages said mortise deadbolt lock element and applies a force in a direction along a fourth axis substantially perpendicular to the reciprocal axis to preclude further rotation of the cam in said second direction.

5. The combination in accordance with claim 4 wherein the cam and said first and second stop arms comprise a unitary assembly.

6. The combination in accordance with claim 5 wherein said first stop arm is spaced from the cam generally at the same angle said second stop arm is spaced from the cam.

7. The combination in accordance with claim 6 wherein said first stop arm and said second stop arm have distal ends, and wherein said distal ends are beveled to define generally planar surfaces so that, when one of said distal ends engages the lock element, the generally planar surface defined at the distal end of the stop arm is in substantially full engagement with a surface of the lock element which it engages.

8. The combination in accordance with claim 7 wherein said first stop arm is substantially symmetrical, relative to the cam, with said second stop arm.

9. The combination in accordance with claim 8 wherein the cam has, formed in a proximal end thereof, a spindle receiver.

10. The combination in accordance with claim 4 wherein the deadbolt actuation cam is mounted between generally parallel side plates, and wherein said axis about which the cam is mounted for rotation is generally perpendicular to planes defined by the side plates.

* * * * *

UNITED STATES PATENT AND TRADEMARK OFFICE

CERTIFICATE OF CORRECTION

PATENT NO. : 8,256,251 B2
APPLICATION NO. : 12/433486
DATED : September 4, 2012
INVENTOR(S) : Michael Kondratuk It is certified that error appears in the above-identified patent and that said Letters Patent is hereby corrected as shown below:

Column 5, Line 37, in the line reading "approaches a first rotated position, said stop arm engages", the word "first" should be deleted.

Signed and Sealed this
Ninth Day of October, 2012

David J. Kappos

David J. Kappos
*Director of the United States Patent and Trademark Office*